US007246723B2

(12) United States Patent
Santagiuliana

(10) Patent No.: US 7,246,723 B2
(45) Date of Patent: Jul. 24, 2007

(54) BELLOWS PUMP FOR DELIVERY OF GAS-LIQUID MIXTURES

(75) Inventor: Stefano Santagiuliana, Caldogno (IT)

(73) Assignee: Taplast SpA, Dueville (VI) (IT)

( * ) Notice: Subject to any disclaimer, the term of this patent is extended or adjusted under 35 U.S.C. 154(b) by 423 days.

(21) Appl. No.: 10/478,850

(22) PCT Filed: Jun. 12, 2002

(86) PCT No.: PCT/IB02/02175

§ 371 (c)(1),
(2), (4) Date: Nov. 25, 2003

(87) PCT Pub. No.: WO02/100554

PCT Pub. Date: Dec. 19, 2002

(65) Prior Publication Data

US 2004/0149777 A1 Aug. 5, 2004

(30) Foreign Application Priority Data

Jun. 13, 2001 (EP) ..... 01830390

(51) Int. Cl.
*B65D 37/00* (2006.01)

(52) U.S. Cl. ..... 222/209; 222/207; 222/190; 222/321.7; 239/330

(58) Field of Classification Search ..... 222/207, 222/209, 321.7, 211, 153.13, 321.9; 239/372, 239/330

See application file for complete search history.

(56) References Cited

U.S. PATENT DOCUMENTS 4,220,264 A * 9/1980 Gamadia ..... 222/207
4,880,161 A * 11/1989 Wright ..... 239/330
5,289,952 A 3/1994 Gueret ..... 222/189
5,326,000 A 7/1994 Fuchs ..... 222/321
5,443,569 A 8/1995 Uehira et al. ..... 222/190
5,462,208 A * 10/1995 Stahley et al. ..... 222/207
5,518,147 A * 5/1996 Peterson et al. ..... 222/153.07
5,813,576 A 9/1998 Iizuka et al. ..... 222/190
6,193,112 B1 2/2001 Santagiuliana ..... 222/153.13
6,805,267 B2 * 10/2004 Bougamont ..... 222/633

FOREIGN PATENT DOCUMENTS

| | | |
|---|---|---|
| EP | 0 806 249 | 11/1997 |
| FR | 2 792 553 | 10/2000 |
| WO | 01/39893 | 7/2001 |

* cited by examiner

*Primary Examiner*—Patrick F. Brinson
(74) *Attorney, Agent, or Firm*—Dykema Gossett PLLC

(57) ABSTRACT

A pump for delivery of gas-liquid mixtures adapted to be connected to a container for a liquid comprising: suction means adapted to be reciprocated between a first rest position and a second position so as to collect the liquid from the container; a mixing chamber in communication with the suction means so that when the suction means are moved from a first position to a second position, the liquid is collected from the container and conveyed into a mixing chamber; elastic means adapted to displace the suction means back in the first position after that the suction means are moved from a first position to a second position. The elastic means define a variable volume gas chamber in communication with the mixing chamber so that, when the suction means are moved from a first position to a second position, the gas is conveyed into the mixing chamber and a gas-liquid mixture is formed in the mixing chamber.

29 Claims, 17 Drawing Sheets

BELLOWS PUMP FOR DELIVERY OF GAS-LIQUID MIXTURES

The present invention relates to a bellows pump for delivery of gas-liquid mixtures.

The manually operated pumps fixed to the neck of a container for instance made of plastics, containing a liquid substance, are more and more used for delivery of gas-air mixtures that may be in the form of foamy substances or nebulized liquid. Use of such kinds of pumps is of interest of many fields such as food, hygienic and industrial field.

At least two are the requirements particularly felt both for construction and distribution of pump delivery systems as above mentioned.

The first requirement consists in that the entire pump assembly generating the air-gas mixture be made with mutually compatible materials in the sense that they should be easily recyclable. For this reason one aims at avoiding the presence of metal parts in the pumps that are generally made of plastics, so as to avoid the necessary separation between plastics and metals.

This is the reason, why the so-called bellows pumps are preferred to the traditional pumps because the elastic return of the bellows replaces the metal spring.

The second requirement consists in that one aims at reducing to the minimum the space occupied by this pump inside the container, for obvious reasons of optimizing and maximizing the liquid volume so that the container is as much small as possible, the volume of liquid being equal.

Another requirement particularly felt by the manufacturers of the bellows pumps of this kind is to be able to unify as much as possible the construction of these pumps so as to make practically irrelevant the structure of the pump relative to the dose of liquid that should be mixed with air.

According to the prior art some structures of bellows pump provide for arranging the bellows inside the container and the bellows constitutes the chamber for the gas that will be mixed with the liquid taken from the container.

It is clear that a structure of this kind involves a rather significant waste of space inside the container. Moreover the container neck should be sufficiently wide to receive most part of the pump mechanisms, namely the bellows and the liquid chamber.

Moreover when the type of liquid to be mixed or the pump performance are changed, clearly also the container should be changed because the container neck cannot be fitted to the bellows pump applied thereto.

The bellows pumps of the prior art have also the drawback that any undelivered liquid or dissociated residual foam returning to the liquid state, leak along the pump stem and tend to fill the bellows inner volume.

The presence of this accumulation of liquid causes the modification of the mixing ratio when this is delivered and jeopardizes the quality of the foam.

Moreover when the delivery device is not used for several days, the residual liquid could become hardened or worse dried resulting in blocking the pump operation.

The object of the present invention is to remove the above mentioned drawbacks.

More particularly a first object of the invention is to provide a bellows pump in which prolonged accumulation of undelivered liquid inside the bellows does not occur.

Another object of the invention is to provide a pump delivering a foam having a time constant composition.

A further object of the invention is to provide a bellows pump with a more reliable operation.

Another object of the invention is to provide a bellows pump that is adapted to deliver gas-liquid mixtures even with liquids of different density characteristics and occupying minimum space inside the container.

A further object is to provide a bellows pump that is able to deliver different quantities of gas-liquid mixtures still keeping the same dimensions of the pump body arranged inside the container.

Still another object of the invention is to provide a sealed bellows pump to avoid entry of water or other liquids inside the bellows on use.

Another object of the invention is that any possible modification of the pump for liquids with different delivery characteristics or different delivery functions such as foaming or nebulization, may be carried out by replacing a minimum number of pump components, without being obliged to make pumps totally different as to dimensions and/or components.

All the foregoing objects and others that will be better pointed out hereinafter are attained by the bellows pump for delivery of gas-liquid mixtures, whose main characteristics are recited in the main claim.

According to a preferred embodiment, inside the bellows the pump is provided with means for collecting the undelivered residual liquid.

In this way the liquid so-collected is advantageously ejected in the following delivery so as to avoid to modify the composition of the delivered foam, whose qualitative characteristics remain constant with time.

Still advantageously it is avoided that such liquid dries and jeopardizes the pump operation.

Moreover and again advantageously the pump has the bellows arranged outside the container and said bellows in addition to the function of elastic return, also forms the chamber for the gas to be mixed with the liquid.

Moreover the liquid-gas mixing chamber is advantageously arranged inside the room bounded by said bellows and said delivery device.

A particular care is taken to make the bellows sealed, so as to maximize its efficiency as gas chamber, at the same time avoiding leakage of liquid or foam from the bellows inside. Indeed to this purpose special care was taken to recover possible residues of non foamed or non nebulized liquid, providing in some embodiments a receptacle at the bellows base collecting said residues and ejecting them on pump operation.

Moreover the pump of the invention is also provided with the possibility of delivering different liquid doses, having a hollow body cooperating with the piston rod, running in grooves of different length according to the position taken relative to said hollow body thus adjusting the piston stroke.

Another feature of the invention is that the bellows controlling the pump compression and its return to the rest position, is made of plastics with constant resistance and elasticity features, so that during application of hand pressure, contraction of the bellows occurs in a uniform way and to the same extent at all its parts. This makes the bellows shape independent from the realized effect. In other words, should bellows be of a frustum-conical or cylindrical shape, it obtains the same result of gas-liquid mixture, since the variation of gas pressure inside the bellows between start and end of the stroke is substantially irrelevant. This is due to the low amount of air volume in the bellows, the velocity with which the reduction of the bellows volume occurs and also because the bellows air at start of the compression, begins immediately to go into the mixing chamber where it is mixed with the liquid.

Further characteristics and features of the invention will be better understood from the description of particular embodiments of the invention shown in the accompanying sheets of drawings in which.

Figure 1:
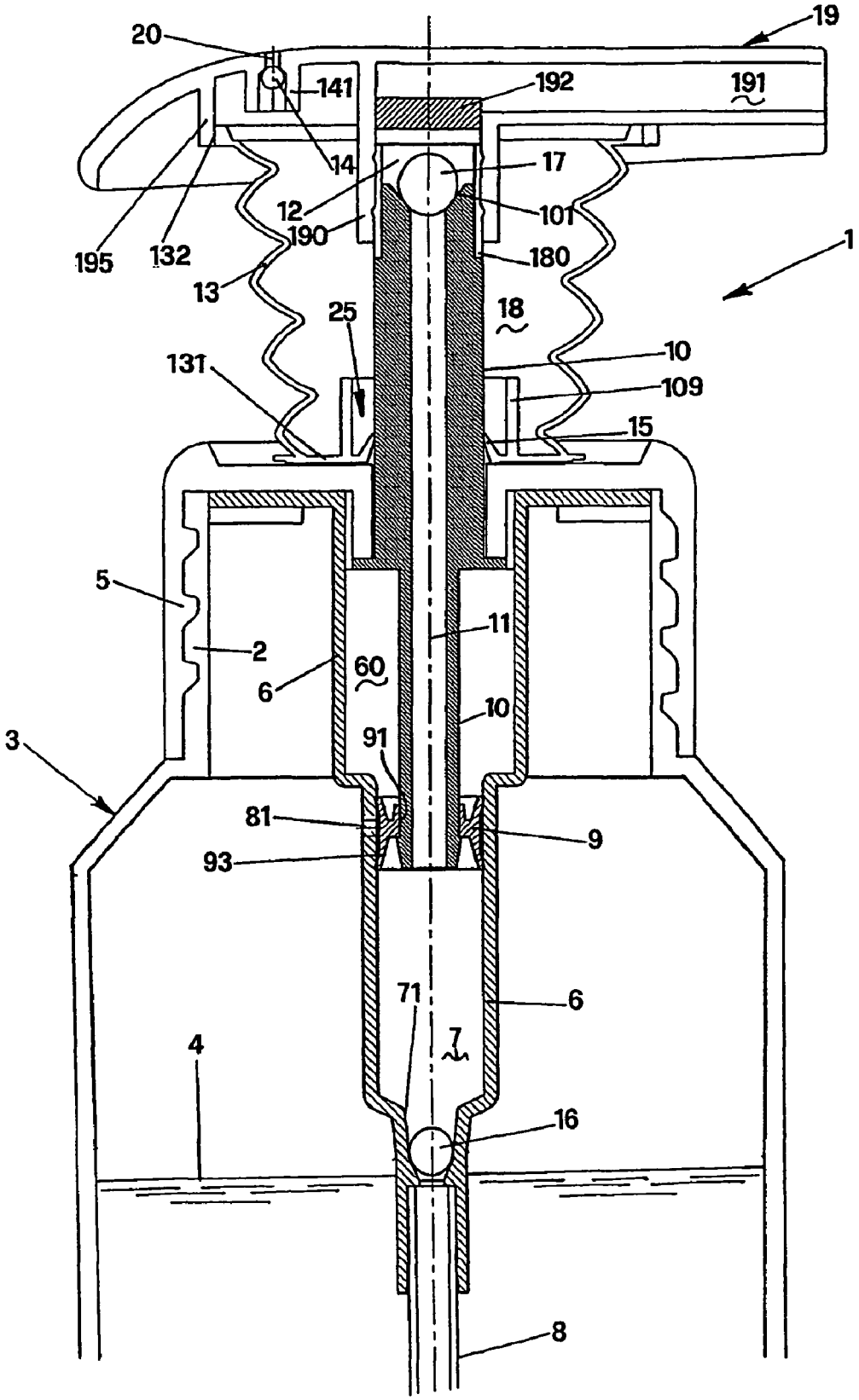
FIG. 1 is a sectional view of a first embodiment of the pump of the invention.
Figure 4A:
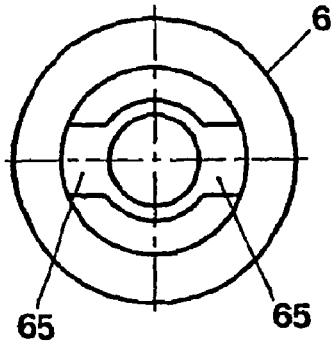
Figure 4:
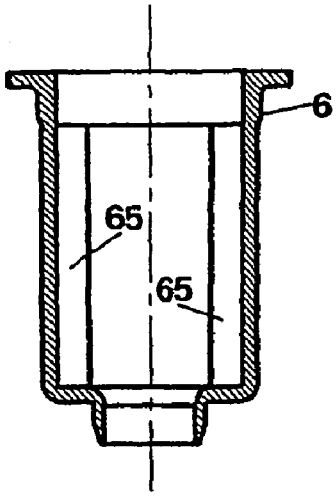
Figure 5:
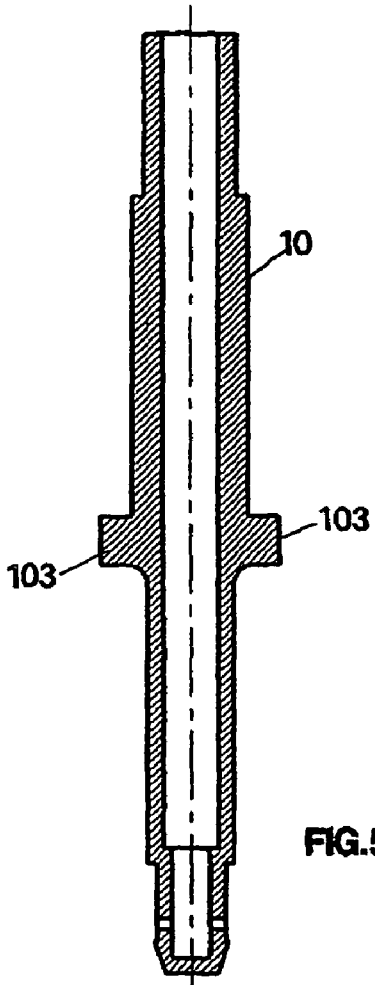
Figure 5A:
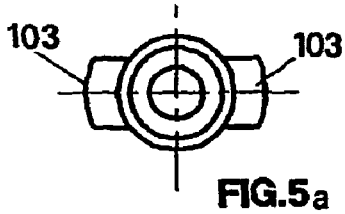
Figure 6:
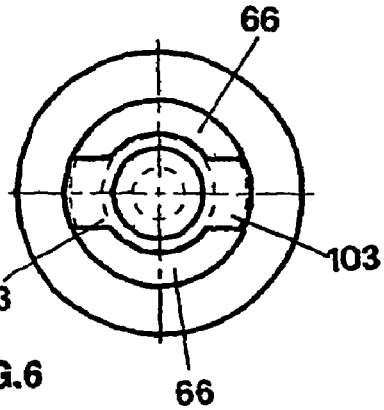
Figure 7:
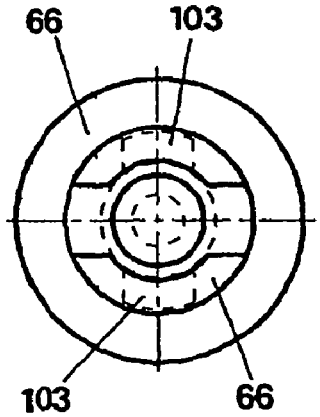
Figure 8A:
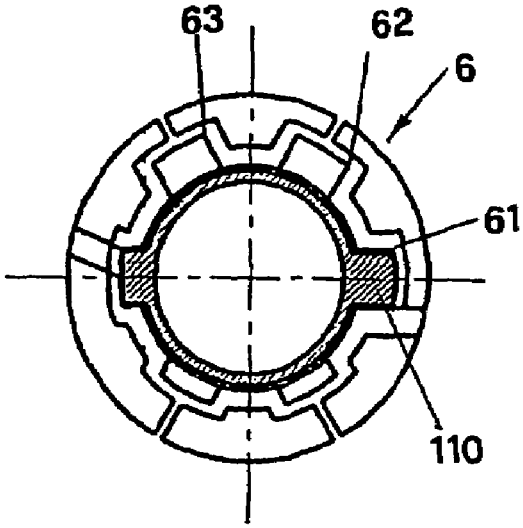
Figure 8B:
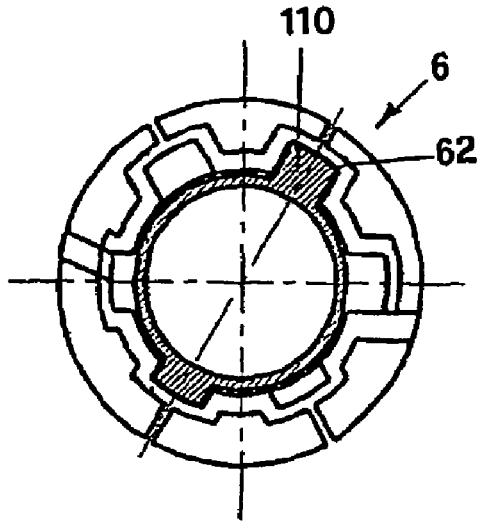
Figure 8C:
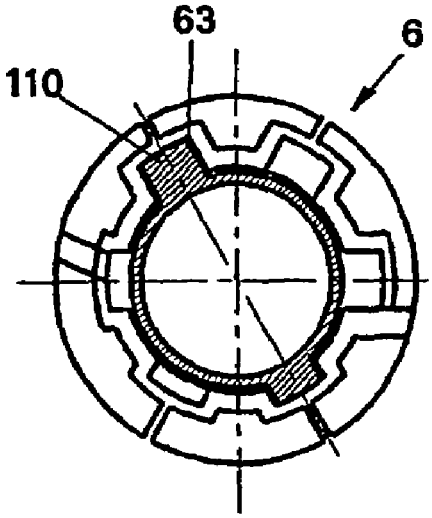
Figure 8D:
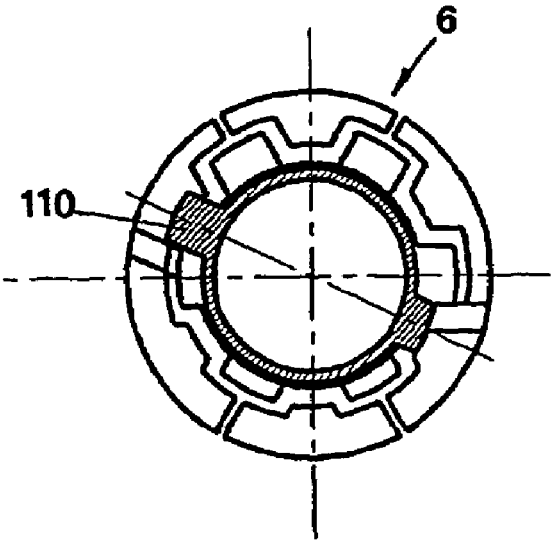
Figure 9:
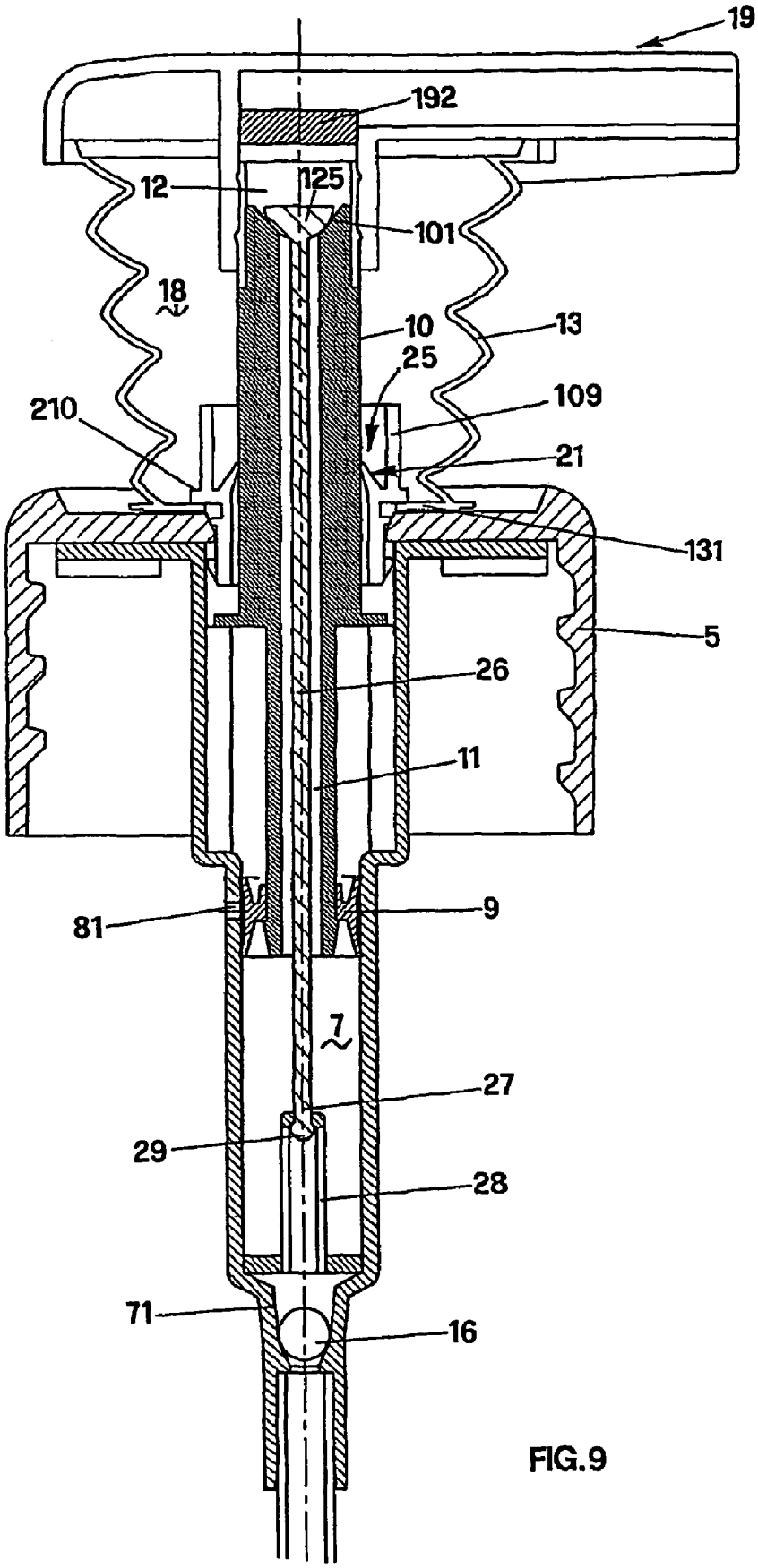
Figure 10:
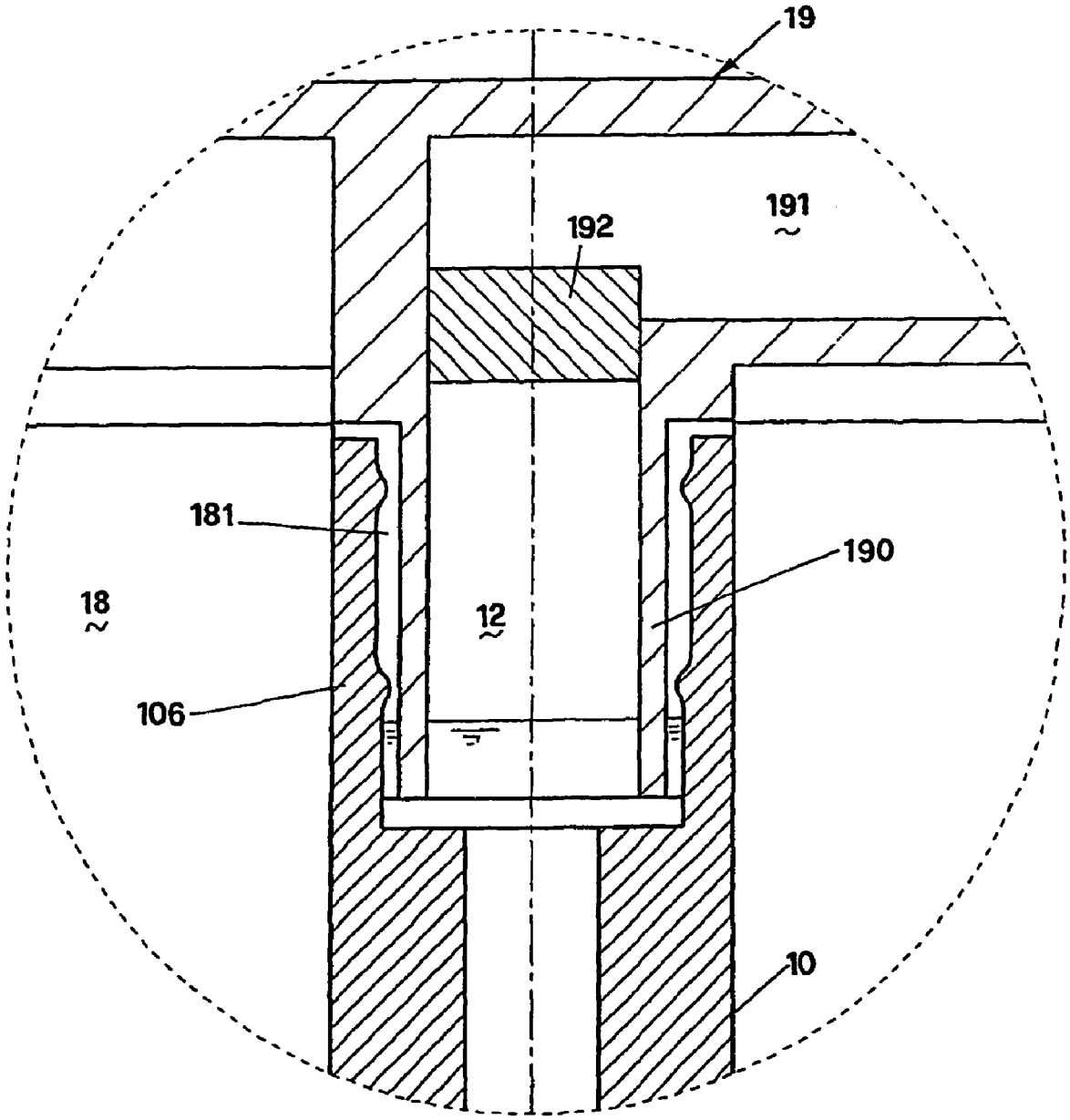
Figure 11:
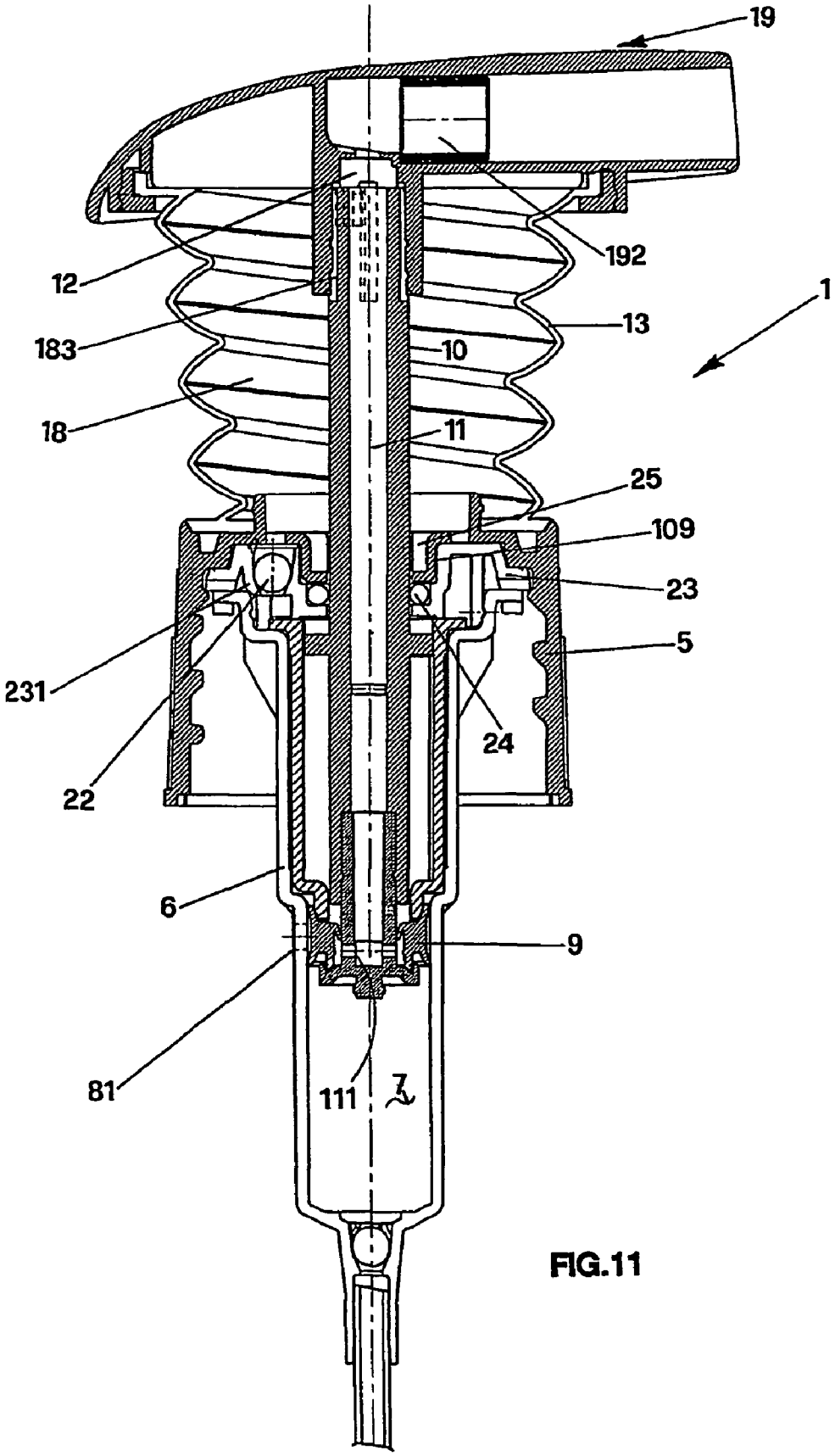
Figure 13:
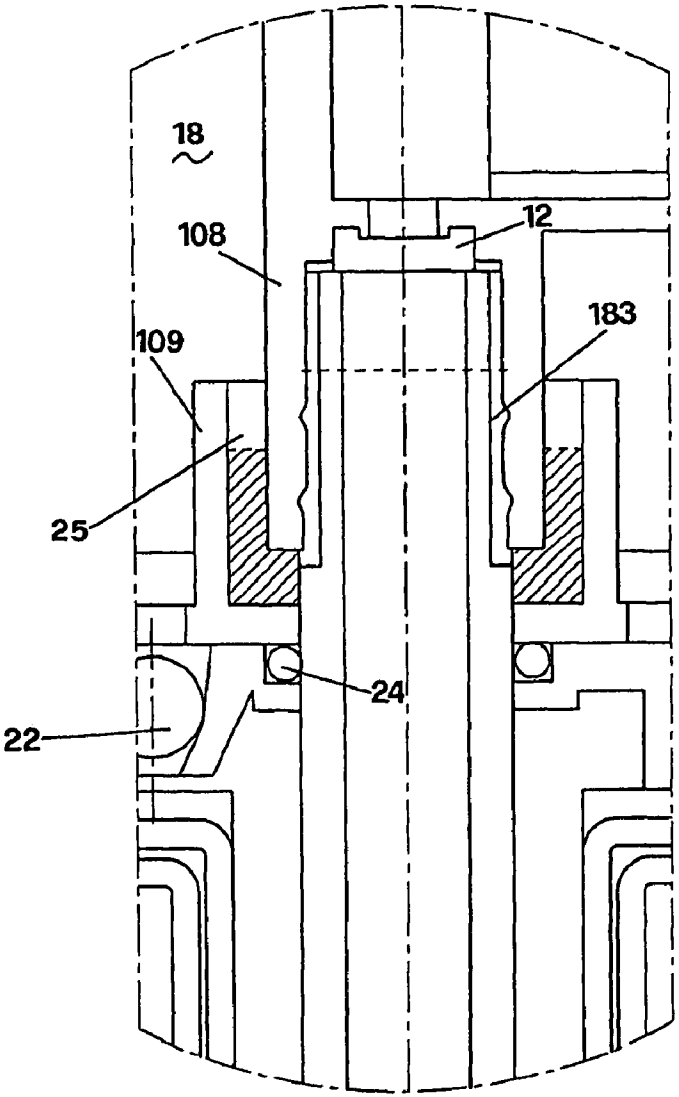
Figure 12:
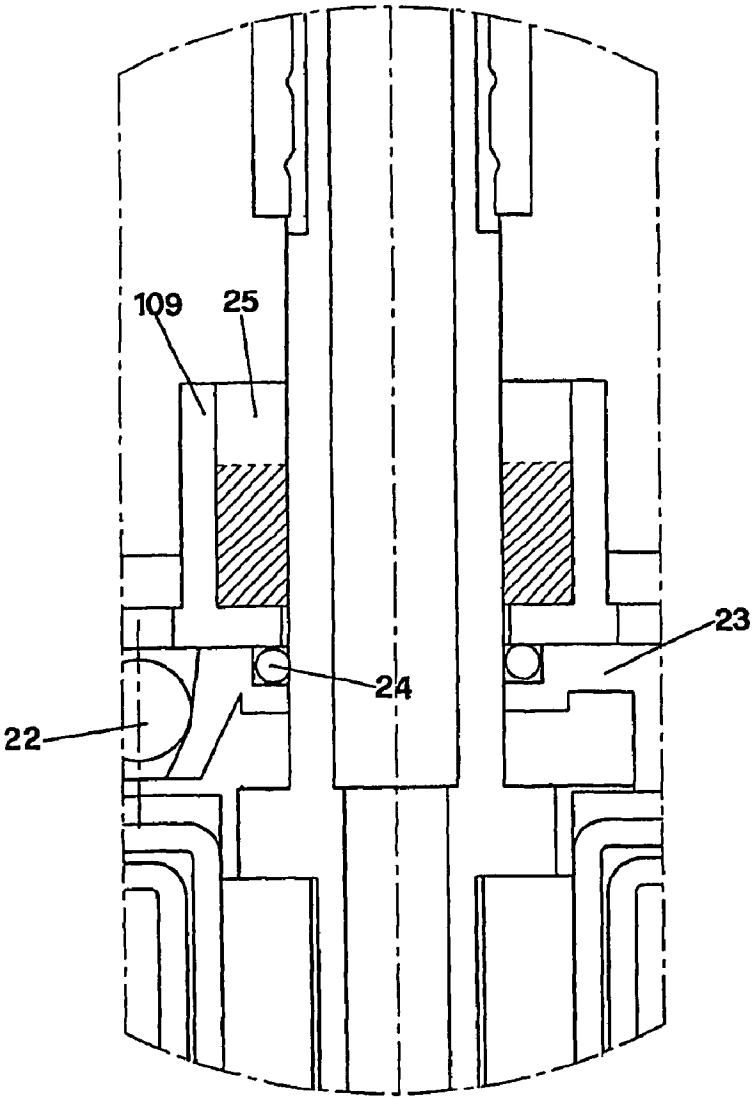
Figure 14:
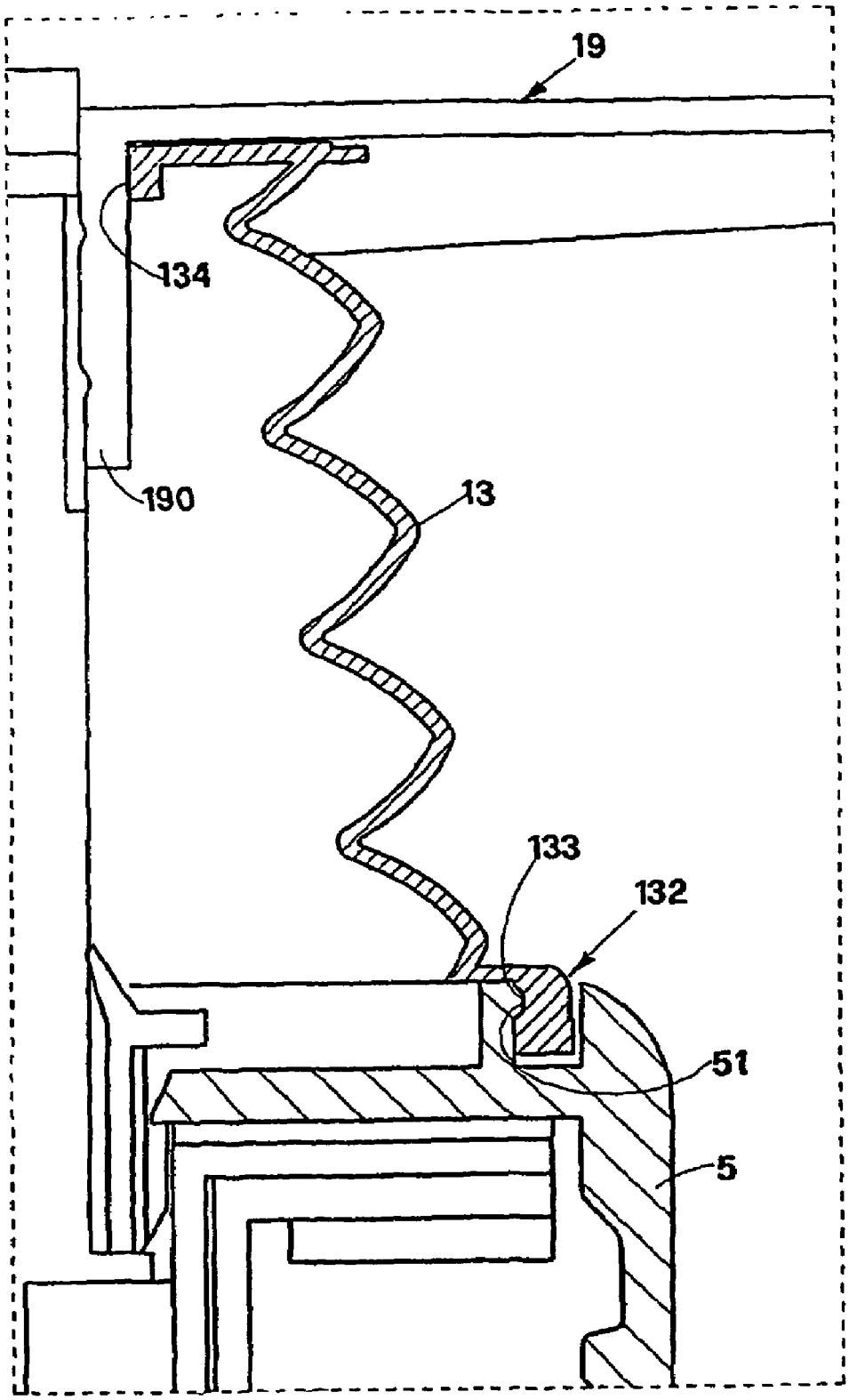
Figure 15:
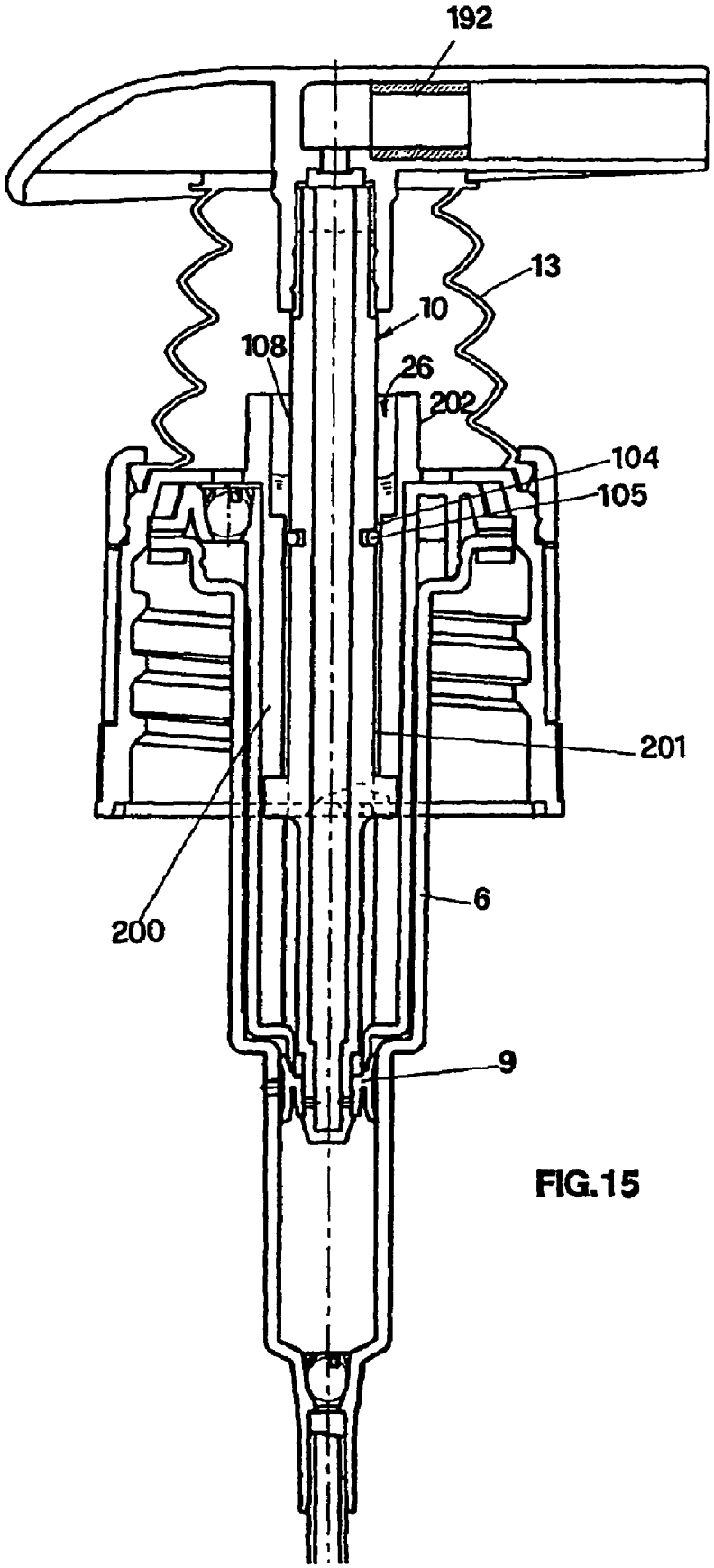
Figure 16:
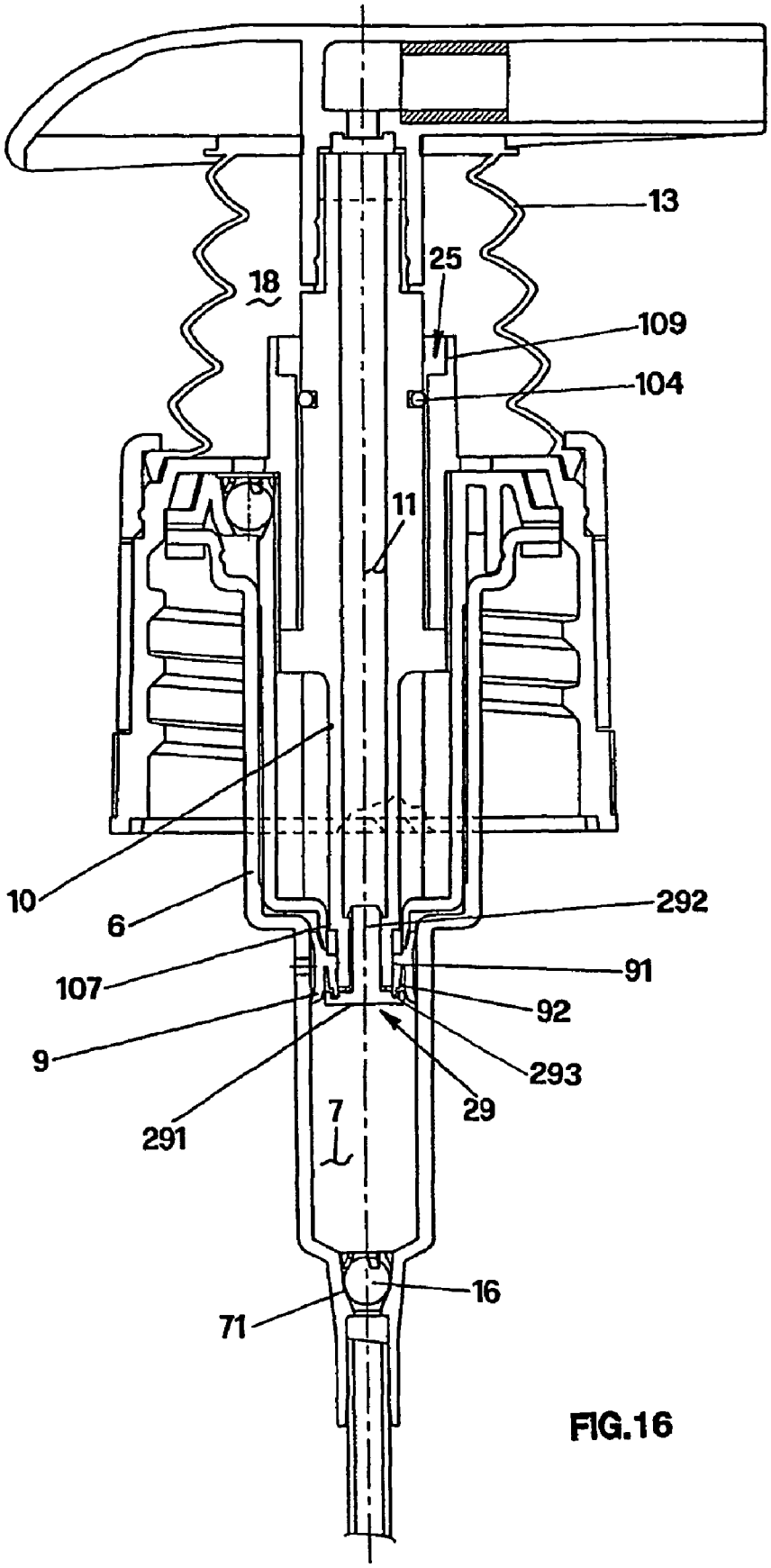
Figure 17:
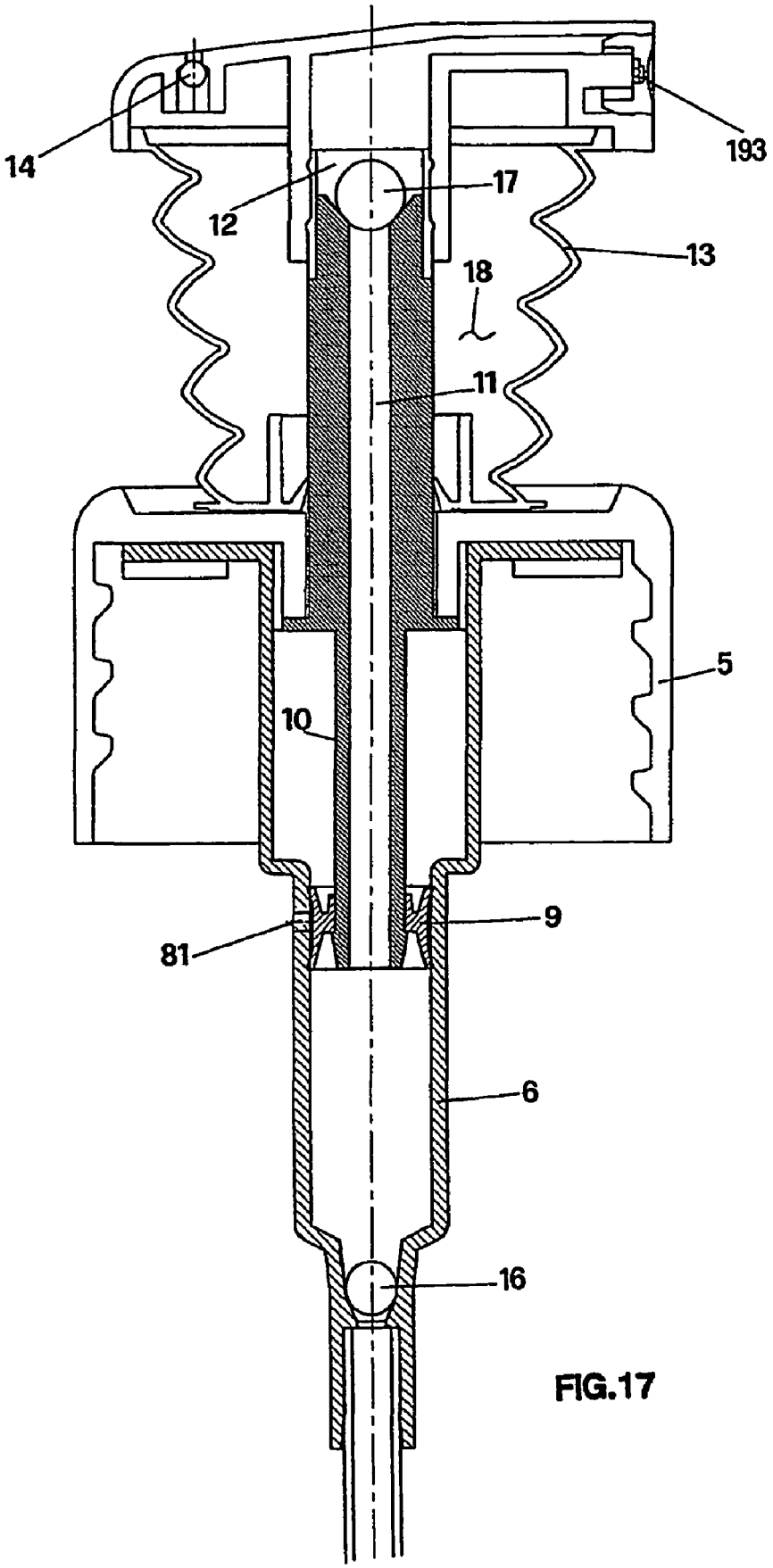

FIGS. 4 and 4*a* are a sectional and a plan view respectively, of the hollow body of a monodose pump of the invention in which the piston rod is sliding;

FIGS. 5 and 5*a* are a sectional and a plan view respectively of the piston rod to be coupled with the hollow body of FIG. 4;

FIGS. 6 and 7 are two different sectional views of the hollow body and the piston rod of the pump of FIGS. 4 and 5 mutually coupled in the sliding and blocking position respectively;

FIGS. 8*a* to 8*d* are sectional views of the different positions taken by the piston rod relative to the hollow body of a multi-dose pump of the invention to carry out different piston strokes;

FIG. 9 is a view of another variation of the pump of the invention;

FIG. 10 shows a particular configuration of the connection duct between gas chamber and mixing chamber in the pump of the invention;

FIG. 11 shows another constructional variation of the invention;

FIGS. 12 and 13 show details of the annular receptacle provided in the embodiment of FIG. 11;

FIG. 14 shows the details of the sealing arrangement of the bellows of the pump of FIG. 11;

FIG. 15 is a constructional variation derived from the pump of FIG. 11 with a different configuration of the annular receptacle;

FIG. 16 is a further, variation of the pump of the invention;

FIG. 17 is a variation of FIG. 1 in which the pump is provided with an atomizer of the gas-liquid mixture; and FIGS. 18*a*, 18*b*, 18*c* and 18*d* show a modification of the pump of FIG. 15 during the different operative phases.

With reference now to the figures of the drawings and more particularly to FIG. 1, one can see that the pump of the invention generally indicated with 1, is connected to the neck 2 of the container 3 for instance made of plastics, inside containing the liquid 4. The neck 2 generally has a thread so that the plug 5 may be blocked by screwing on it.

The pump 1 has a hollow body 6 defining two generally cylindrical stretches, on the first stretch 60 the rod 10 of a piston 9 is sliding during pump operation.

The hollow body 6 below the first stretch is provided with a generally cylindrical chamber 7 inside which the liquid 4 sucked by the piston 9 is coming through the suction duct 8. The valve 16 as explained hereinafter, arranged in the frustum-conical bottom 71 of chamber 7, prevents that liquid sucked inside the chamber 7 may return inside the container 3.

As shown in FIG. 1, the bellows 13 has the double function of elastic element and gas containing chamber as well, said gas being used for carrying out mixture of gas and liquid. The function of elastic element is carried out by the bellows and depends very slightly on its shape and mostly on the special nature of the plastic material by which is moulded giving special parameters of resistance and flexibility. The preferably used plastic materials belong to the group comprising polyethylene and polypropylene.

The bellows 13 is generally provided with a constant resistance when undergoes a constant pressure force so that its sections collapse at the same time independently from their size. This makes the performance of the bellows independent from the shape this being for instance frustum-conical, cylindrical or other shape.

The bellows 13 defines an inner gas chamber 18, more particularly air, said air entering during the pump suction phase through the hole 20. On the contrary during the compression phase of bellows 13, the ball 14 received in the cavity 141 made inside the delivery device 19, seals the hole 20. Therefore during compression air contained in the gas chamber 18 goes out through the connection duct indicated with 180 and reaches the mixing chamber 12, where also the liquid is coming, running from the liquid chamber 7 through the feeding channel 11 until it reaches said mixing chamber 12. During movement of the rod 10 of piston 9, the bellows sealing is warranted by a first lip seal 15 formed on the bellows annular base 131.

Another bellows sealing element is that connecting to the delivery device 19. In this case sealing occurs on the bellows ring 132 coupled on the corresponding ring 195 belonging to the delivery device 19.

With regard to the liquid chamber 7, one can see that in the embodiment of FIG. 1 said chamber has second valve means on the bottom of the chamber 7, consisting of a first ball 16 arranged on the bottom part of chamber 7, with a generally frustum-conical development indicated with 71. Such a ball closes the communication between chamber 7 and the liquid suction duct 8 during the pump compression phase, while during the suction phase it allows passage of liquid from container to chamber 7.

A second valve means defined by ball 17, avoids that liquid reaching the chamber 7, comes directly to the mixing chamber 12 in this suction phase.

As shown in FIG. 1 the ball 17 is arranged in a frustum-conical seat 101 at the top of rod 10, being a cavity on the edge of rod 10. When the pump is in the rest stage as shown in FIG. 1, the piston 9 and more particularly the outer surface 93, keeps closed the communication between the hole 81 made on the body 6 and the volume 60 of the hollow body 6, because in case of opening of the hole 81 said volume being not sealed could allow outflow of liquid to the outside. Thus the certainty is obtained that in the rest position the pump of the invention does not allow outflow of liquid from the container in any position, as the container could be arranged even horizontal or upside down.

When the pump is in the suction phase and the piston 9 is in the lower position, the phase of air recovery inside the container 3 occurs in the chamber 7, said recovery occurring through air passage at hole 81 with air coming from outside. This happens because external air may pass under the annular base 131 of the bellows 13 because the bellows is in the air suction phase and is not compressed on the support ring of plug 5.

It is to be pointed out that all the elements constituting the pump, of the invention of these embodiments as well as of all the other modifications that will be described hereinafter, are made of plastics.

One can see that the pump of the invention carries out maximization of the space available inside the container, because the entire part comprising the gas chamber and the gas-liquid mixing chamber as well, is arranged outside the container and more particularly above the plug 5 of the container.

During the compression phase the liquid contained in chamber 7 enters the feeding channel 11 and reaches the mixing chamber where it is mixed with air, and through a mixture optimization means 192, that in this embodiment is a pad provided with micro-holes, feeds inside the duct 191 the liquid-gas mixture in the form of foam.

On use any undelivered liquid or dissociated foam residues returning to the liquid state, are leaking from the mixing chamber 12 along the rod 10 and tend to accumulate inside the bellows 13.

In order to prevent this, proper collection means are provided, consisting of an annular receptacle 25 arranged inside the bellows 13. Such annular receptacle 25 as shown, consists of an annular surface 109 arranged externally to the rod 10 and belonging to the annular base 131 of bellows 13.

In this way the undelivered liquid or foam residues sliding down the rod 10, are collected in the annular receptacle 25 to be delivered in the following pumping phase.

Figure 2:
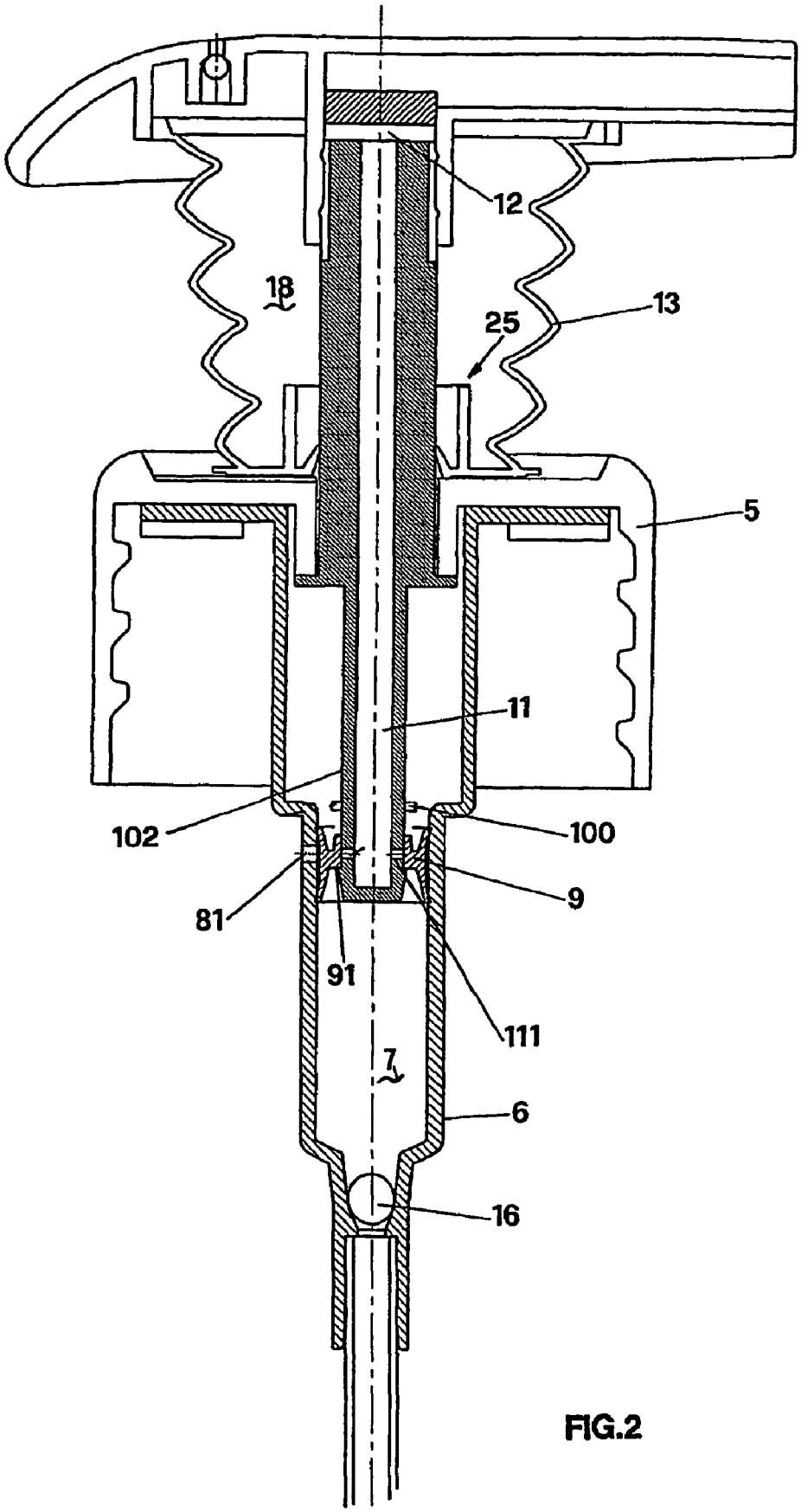
FIGS. 2 and 3 show a variation of the pump of FIG. 1.
Figure 3:
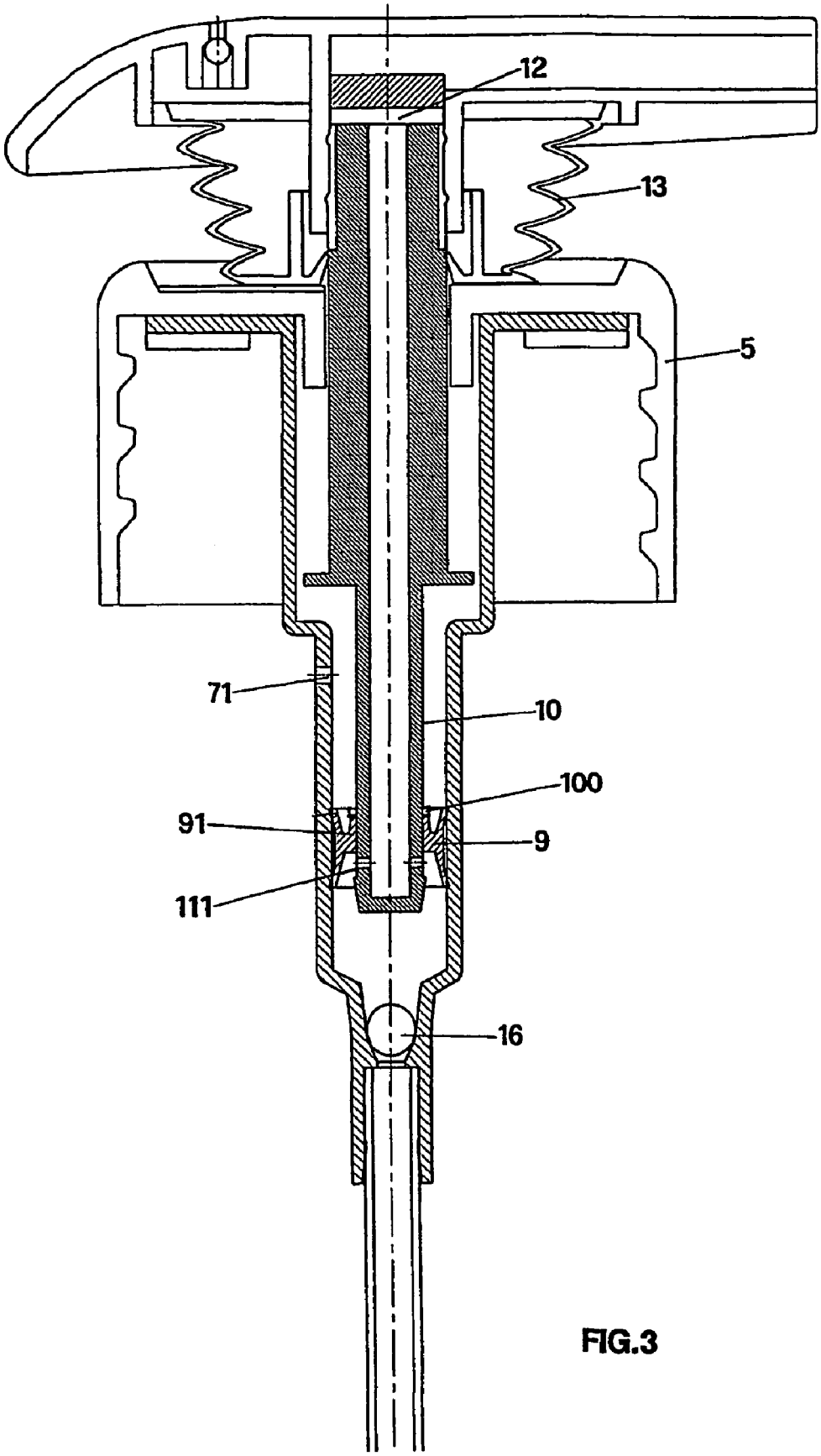

In FIGS. 2 and 3 a constructional modification of the pump of the invention shown in FIG. 1 is illustrated. In this modification the ball 17 is missing, that was the second valve means closing the connection between the feeding channel 11 and the mixing chamber 12. In the embodiment of FIGS. 2 and 3, the task of closing the feeding channel 11 and therefore the mixing chamber 12 relative to the liquid chamber 7 in the rest position is carried out by the pump piston 9 provided with a tubular cylindrical ring 91 slidingly coupled to the outer surface 102 of the rod 16 of piston 9 that in the rest position closes a hole 111 communicating with the feeding channel 11. It is clear that in the condition of FIG. 2 the liquid contained in chamber 7 cannot pass to the feeding channel. In this case it is to be, noted that the piston 9 carries out a double closure, namely a closure preventing leakage to the outside of liquid 4 contained inside the container 3 because the hole 81 is closed, and also closure of the hole 111 thus preventing any leakage of liquid contained in chamber 7 to the outside, for instance in case of turning the container upside down.

The closure condition of hole 111 ends when the bellows starts to be squeezed as shown in FIG. 3. In this condition the rod 10 moving downwards and sliding for a determined stretch relative to piston 9, clears the hole 111 thus allowing inflow of liquid contained in chamber 7 inside the feeding channel 11 so that the liquid can reach the mixing chamber 12. Protrusions 100 provided on the outer surface of rod 10 allow to drag downwards piston 9 during the rod descent from a certain point downwards.

The pump of the invention in all the illustrated constructional versions, is provided with a lock device preventing the piston rod to move downwards and to actuate the pump.

As show in FIGS. 4 and 4*a*, the hollow body 6 of the pump, in this case being a mono-dose pump, is provided with two equal and diametrically opposite grooves 65 inside which the protrusions 103 may slide as shown in FIG. 5. The protrusions 103 are also diametrically opposite and have a shape conjugated with that of the grooves 65. It is clear that when the protrusions 103 are inside the grooves 65, the rod 10 of the associated piston 9 may move freely downwards. This is the condition that can be seen in FIG. 6. On the contrary when the rod 10 is rotated in such a way that the protrusions 103 are transversal to the grooves 65 as shown in FIG. 7, such protrusions abut on flat surfaces 66 constituting the upper edge of the body 6 and actually prevent the downward movement along the axis of rod 10. FIGS. 8*a* to 8*d* are sectional views of the body 6 which is provided with a plurality of grooves indicated with 61, 62, 63 having different depths. Therefore the protrusion 110 belonging to the rod 10 according to the groove in which it is inserted, during the rod actuation may travel only for the length of the groove inside which it is moving. Therefore the result will be that a different stroke of the rod causes a different stroke of the piston and consequently a different suction of liquid volume inside the chamber 7. In other words with such a construction the pump of the invention may deliver different doses of liquid and therefore of foam or aerosol.

Since to obtain a perfect foaming or atomizing operation, a predetermined gas-liquid ratio is required, this depending also on the viscosity of the liquid, it is clear that the variation of the selected dose to be mixed with gas, involves also a variation of the quantity of air to be mixed together with the selected dose. The pump of the invention allows to change the air ratio relative to the liquid ratio to respect the optimal mixture, to this purpose being sufficient to replace only the bellows so as to change the air volume or replacing bellows and delivery device, so that coupling between bellows and delivery device occurs in such an optimal way to warrant their sealing. All the other components may remain unchanged, namely the container plug associated to the pump, the hollow body of the pump, the piston and rod with the valve elements connected thereto.

It is clear the advantage to limit to the minimum the constructional variations, also because as above stated, change of doses or change of viscosity of the liquid do not involve change of the container and greater occupation of space by the pump inside the liquid container in comparison of the usual one. It is therefore clear the advantage for the producers of liquid substances that should be mixed with air to obtain foam or aerosol, because they can avail themselves of generally unified containers with the only exception of the screwing member to the container neck.

FIG. 9 shows a variation of the pump of the invention. In such variation the valve means closing the feeding channel 11 relative to the mixing chamber 12 consists of a rod 26 having a generally hemispherical terminal portion 125, abutting on a generally frustum-conical cavity 101 belonging to the edge of rod 10 of piston 9. The rod 26 is guided during stroke of the piston rod, in a hole 27 belonging to a cage 28 and detachment of rod 26 is prevented by a protrusion 29 made at the end of said rod 26. Again in FIG. 9 one can see that, the first valve means of inlet and block of air inside the gas chamber 18, in other embodiments consisting of a ball, in this embodiment are replaced by the annular flat base 131 leaning on the flat surface of plug 5. The annular base 131 is the terminal portion of bellows 13. Air sealing or inlet is carried out by interaction between said base 131 and a second lip seal generally indicated with 21, resting on the annular base through a ring 210 being part of said seal.

In this embodiment the annular surface 109 defining the annular receptacle 25 for collection of undelivered liquid, belongs to said ring 210.

Said second lip seal may undergo slight axial movements and therefore in the bellows compression phase, the ring 210 abuts on the annular base 131 preventing air entry blocking any inlet or outlet of air. On the contrary in the suction phase, the second lip seal 21 is free to move upwards and therefore allows entry of air under the base 131 thus reaching the chamber 18.

A particularly felt problem consists of the likelihood that in the rest position the delivery device 19 did not provide to deliver the entire air-liquid mixture contained in the mixing chamber 12. In this condition it happens that the residual liquid is again condensed and may slide inside the gas chamber 18.

To avoid this trouble, FIG. 10 shows that the connection duct 181 between the gas chamber 18 and the mixing chamber 12 is carried out with a particular shape having the characteristic that the inlet of air coming from the gas chamber 18 is arranged upwards and outlet of air entering the mixing chamber 12 is arranged downwards. In this way in case residues of liquid remain in the chamber 12 in the rest phase, the liquid would occupy a portion of the duct 181 without leaking inside the gas chamber 18. It is clear that when the pump is again actuated, the first compression of the bellows 13 causes the liquid existing in the duct 181 to be fed again inside the mixing chamber 12.

Another constructional modification of the invention is shown in FIG. 11. In this case the first valve means warranting inlet and closure of air inside the gas chamber 18 defined by the inner volume of the bellows 13, consists of a ball 22 arranged in a generally frustum-conical cavity 231 made on a diaphragm 23 positioned between the flat portion of plug 5 and the upper portion of the hollow body 6.

When the pump is in the rest position, possible liquid residues which were not transformed into foam or aerosol that could fall from the air feeding channel 183, are collected by the collection means arranged at the base of bellows 13 as already described in the preceding embodiments, that in this case consists of the annular receptacle 25.

One can see that in this constructional modification sealing between the rod 10 and the diaphragm 23 is obtained through a ring gasket 24 axially comprised between diaphragm 23 and the annular receptacle 25. Also in this case when the pump is being compressed, air compressed by the bellows 13 ejects the possible liquid residue contained in the annular receptacle 25, said liquid travelling again in the channel 183 and being fed again in the mixing chamber 12.

FIGS. 12 and 13 show a magnification of the annular receptacle 25 when the pump is the rest position in FIG. 12 and when the pump is under compression in FIG. 13 and the liquid contained in the receptacle 25 starts to return to the mixing chamber 12 through the duct 183, respectively.

FIG. 14 shows a magnified detail of the pump of FIG. 11 wherein it is highlighted how the hermetic sealing of the bellows 13 is obtained both relative to the plug 5 and the delivery device 19. The base of bellows 13 has an annular bead 132 provided inside with an annular groove 133 conjugated with a corresponding protrusion 51 belonging to the plug 5. This ensures the perfect seal between plug 5 and the base of bellows 13.

As to the sealing between the delivery device 19 and the bellows 13, this is obtained by the forced coupling of ring 134 made at the top of bellows 13, which is coupled with the corresponding cylindrical surface of the tubular joint 190 belonging to the delivery device 19.

In FIG. 15 a constructional modification of the pump of FIG. 11 is shown, wherein the annular receptacle 26 collecting the possible residue of liquid not transformed into foam or aerosol, consists of a portion of cylindrical wall 108 belonging to the rod 10 of piston 9 and a coaxial cylindrical portion 202 belonging to a tubular element 200 which is inserted into the hollow body 6 and on which the rod 10 of piston 9 is sliding. Sealing on the bottom of the receptacle 26 is obtained through an O-Ring 104 positioned in a groove 105 made on the rod 10.

FIG. 16 shows a further constructional modification of the pump of the invention in which the valve means of the liquid chamber 7 in addition to the ball 16 abutting on the bottom of the chamber 7 in the frustum-conical cavity 71, consist of a closure element 29 cooperating with piston 9.

More particularly the closure element 29 consists of a disk-shaped head 291 and a stem 292 inserted on the bottom of the feeding channel 11. The disk-shaped head 291 has a circular groove 293 on which the edge 92 of the portion of cylindrical ring 91 belonging to piston 9 is arranged. Since the piston 9 is slidingly coupled with its surface 91 to the outer surface 107 belonging to rod 10! it is apparent that when the rod 10 moves downward the disk-shaped 291 of the closure element 29 moves away from the edge 92 of piston 9 and allows inlet of liquid contained in chamber 7 inside the feeding channel 11, because the stem 292 has a diameter lower than the hole in which it is arranged.

FIG. 17 shows a constructional modification of pump of FIG. 1 in which the element 192 making the foam is replaced by an atomizing element 193 to allow atomization of the gas-liquid mixture. It is to be pointed out that the atomizer 193 may be applied indifferently to all the constructional modifications that were illustrated as embodiments in the present description and provided with a foam producing device.

Figure 18A:
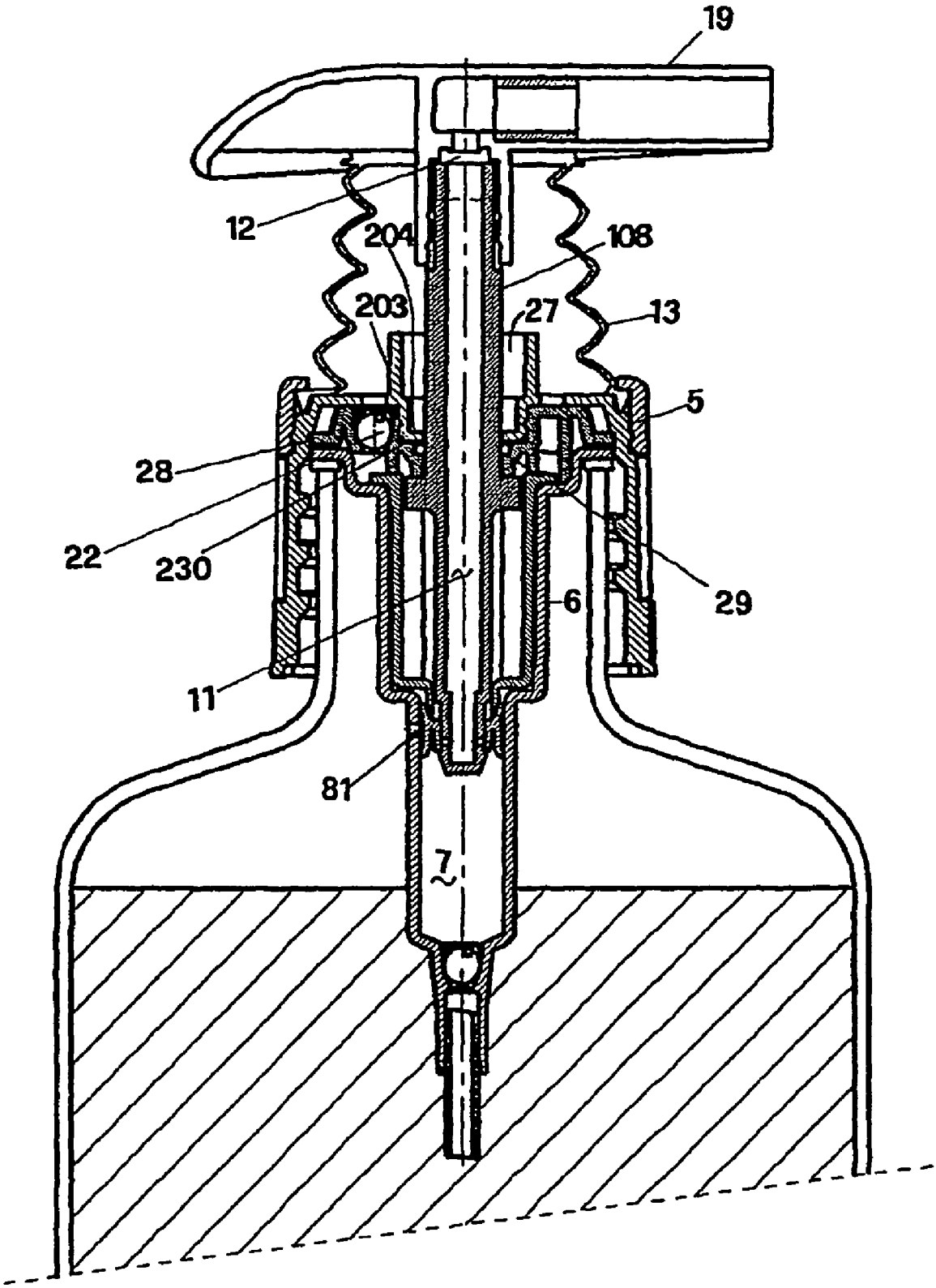

FIG. 18*a* shows in the rest position a bellows pump which is a constructional modification of the pump shown in FIG. 15 provided with an annular receptacle 27 adapted to recover the residual liquid from the mixing chamber 12, bounded by a portion of cylindrical wall 108 belonging to the rod 10 of piston 9, and a generally cylindrical coaxial wall 203 leaning on the bottom 204 of an annular surface 230 belonging to the diaphragm 28. Between the plug 5 and the hollow body 6, the diaphragm 28 has in its annular portion 230 a seat housing a sealing ring 29 which abuts on the bottom 204 of the receptacle 27 in contrast with rod 10 thus obtaining the required sealing.

Figure 18B:
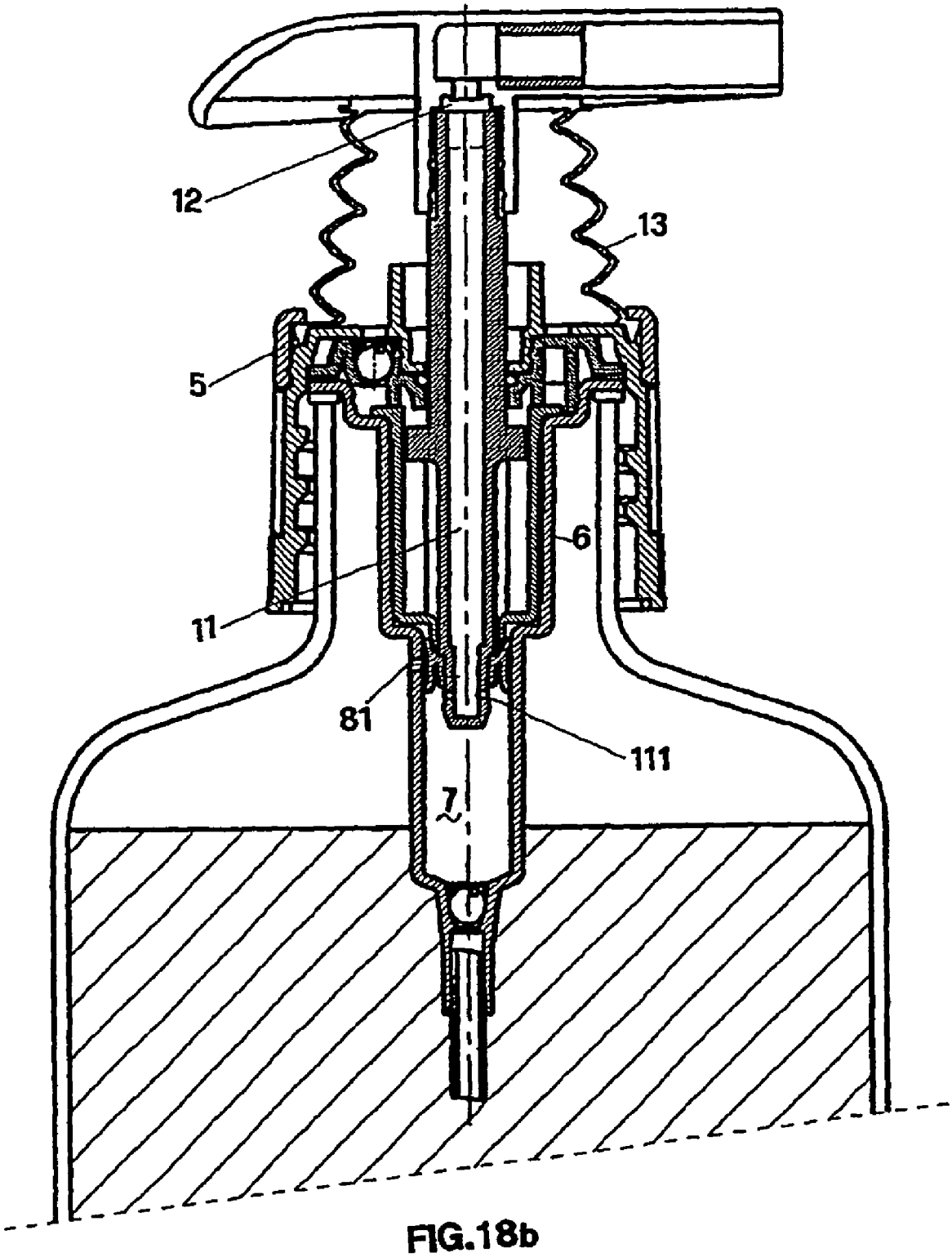

FIG. 18*b* shows a start of compression of bellows 13, where the hole 111 is free from the sealing exerted by the cylindrical part 91 belonging to piston 9 consequently allowing outflow of liquid from chamber 7 to the feeding channel, 11 and then to the mixing chamber 12.

Figure 18C:
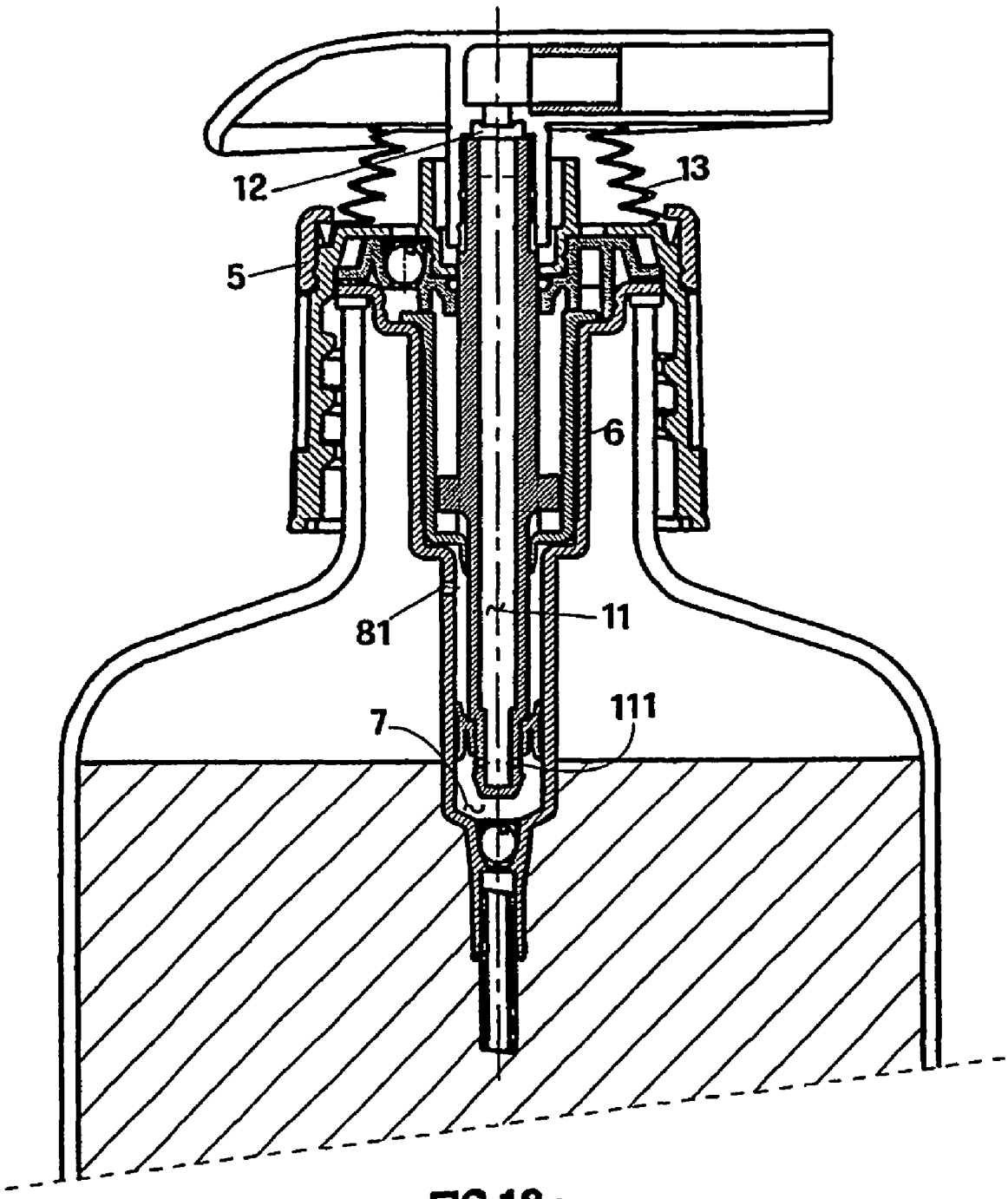
Figure 18D:
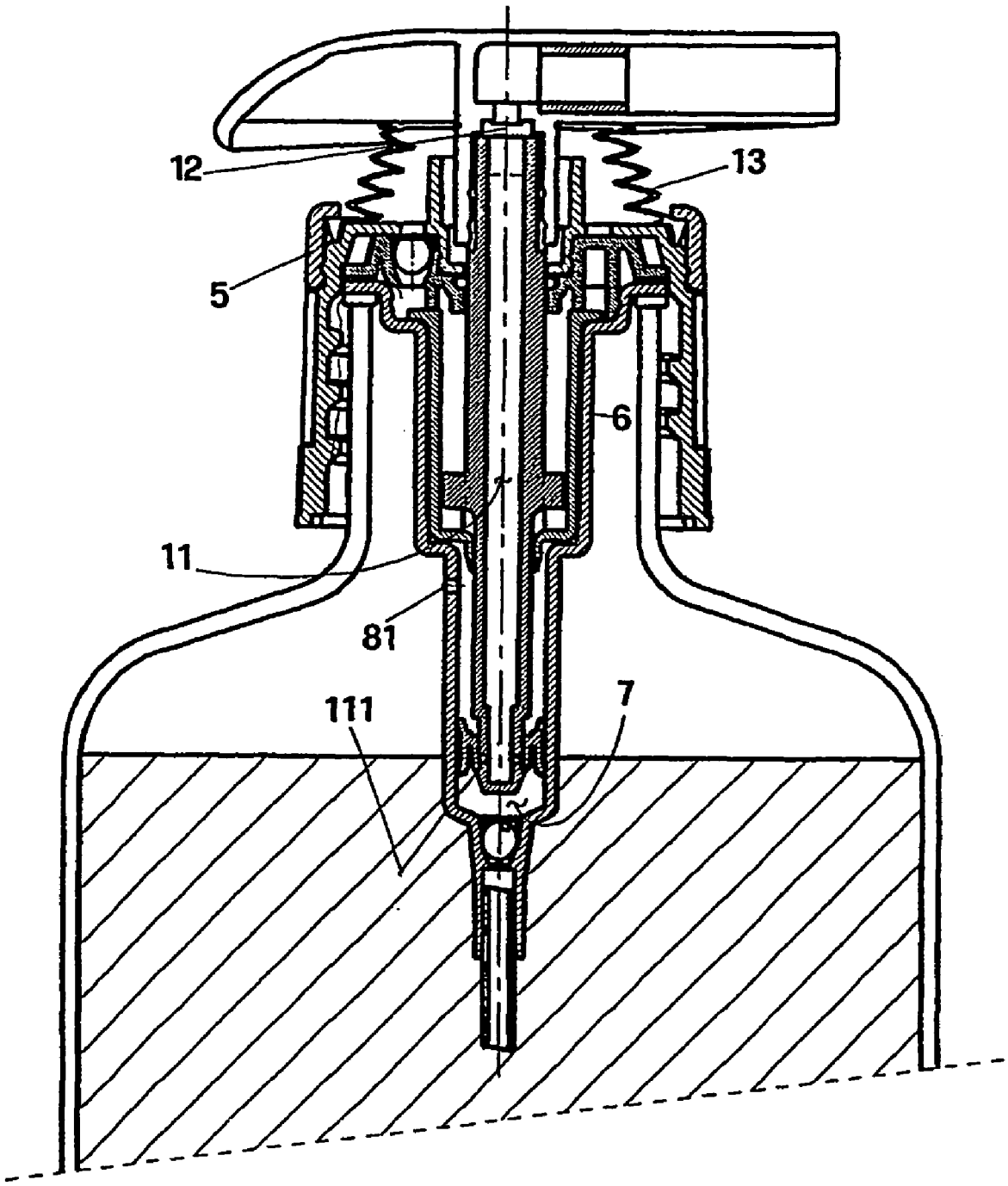

FIG. 18*c* shows the end of the pump compression phase and FIG. 18*d* shows the pump in the release phase. In this latter phase one can see that the hole 111 remains closed by piston 9 and then starts the liquid suction phase through the suction duct 8 inside the chamber 7.

In this phase recovery of air inside the container through the hole 81 occurs and also recovery of air through the bellows 13, allowed by lifting the sealing ball 22.

The invention claimed is:

1. A pump for delivery of gas-liquid mixtures, said pump being adapted to be connected to a container for a liquid, said pump comprising:

suction means adapted to be reciprocated between a first rest position and a second position so as to collect said liquid from said container;

a mixing chamber in communication with said suction means so that when said suction means is moved from said first position to said second position, said liquid is collected from said container and is conveyed into said mixing chamber;

elastic means outside the container and being coupled to and moveable with the suction means, said elastic means adapted to displace said suction means back to said first position after the suction means is moved from said first position to said second position;

wherein said elastic means defines a variable volume gas chamber in communication with said mixing chamber so that, when said suction means is moved from said first position to said second position, said gas is conveyed into said mixing chamber, and a gas-liquid mixture is formed in said mixing chamber.

2. A pump as claimed in claim 1, wherein said mixing chamber for the gas-liquid mixture is arranged inside the space bounded by said elastic means and a delivery device.

3. A pump as claimed in claim 1, wherein said suction means comprises a generally cylindrical hollow body defining a liquid chamber for the liquid to be mixed, said liquid chamber communicating with said container through a suction duct and a piston slidingly housed inside said hollow body, said piston comprising a rod with a feeding channel for conveying the liquid into said mixing chamber.

4. A pump as claimed in claim 1, wherein said elastic means comprises an elastic bellows outside the container and connected to said plug.

5. A pump as claimed in claim 1, wherein said pump further comprises collecting means for collecting the liquid not transformed into mixture leaking from said mixing chamber and descending axially outside said rod.

6. A pump as claimed in claim 1, wherein said pump further comprises first valve means cooperating with said gas chamber and second valve means cooperating with said liquid chamber.

7. A pump as claimed in claim 1, wherein said pump further comprises sealing means for said gas chamber and said liquid chamber.

8. A pump as claimed in claim 1, wherein said sealing valve means for the gas chamber comprises a ball arranged in a generally frustum-conical cavity made on a diaphragm positioned between said plug and said hollow body, said diaphragm having, in a central position, a third lip seal butting on said rod of said piston.

9. A pump as claimed in claim 6 further comprising a delivery device in communication with an outlet of the mixing chamber, wherein said first valve means for the gas chamber comprises a ball positioned in a seat made in the delivery device and adapted to close a hole in communication with the outside said gas chamber, said gas chamber having also a first lip seal formed by a lower flat terminal portion of said bellows having a generally circular annular shape, said lip seal being in contact with the cylindrical surface of the rod of said piston.

10. A pump as claimed in claim 6 wherein said first sealing valve means of the gas chamber comprises an annular base constituting the terminal flat portion of said bellows resting on said plug, said base cooperating with a second lip seal resting on said annular base through a ring belonging to said second lip seal, said second lip seal being able to undergo slight movements along the axis of the rod of piston.

11. A pump as claimed in claim 6, wherein said second valves means associated to said liquid chamber comprises a first ball arranged in a generally frustum-conical sit made on the bottom of said liquid chamber, and a second ball arranged on a generally frustum-conical cavity belonging to the upper end of the rod of said piston.

12. A pump as claimed in claim 6 wherein said second valve means associated to said liquid chamber comprises a first ball arranged in a generally frustum-conical seat arranged on the bottom of said liquid chamber and a piston having a tubular cylindrical ring slidingly coupled to the outer surface of a rod and adapted to close at least a hole made on said rod and putting in communication said liquid chamber with said liquid feeding channel.

13. A pump as claimed in claim 6 wherein said second valve means associated to said liquid chamber comprises a first ball arranged a generally frustum-conical seat arranged on the bottom of said liquid chamber and a rod having a generally hemispherical terminal portion positioned on a generally frustum-conical cavity belonging to the upper end of the rod of said piston, said rod being guided during the piston rod stroke on hole belonging to a cage to the bottom of the liquid chamber.

14. A pump as claimed in claim 6 wherein said second valve means associated to said liquid chamber comprises a first ball arranged in a generally frustum-conical seat positioned on the bottom of said liquid chamber and a closure element consisting of a disk-shaped head and stem inserted on the bottom of the feeding channel, said disk-shaped head having a circular groove cooperating with the edge of the portion of cylindrical ring belonging to piston, said piston being slidingly coupled to the outer surface of the rod.

15. A pump as claimed in claim 3 wherein said piston with its generally cylindrical outer wall seals at least an inlet hole for the recovery air in the container.

16. A pump as claimed in claim 1 characterized by having a connection duct between the gas chamber and the mixing chamber having the inlet of air coming from the gas chamber arranged upwards and outlet of gas to the bottom of the mixing chamber.

17. A pump as claimed in claim 16 wherein said connection duct comprises an annular duct bounded by two generally cylindrical concentric surfaces, the one belonging to the top of the rod of piston and the other belonging to the joint member of the delivery device for said gas-liquid mixture.

18. A pump as claimed in claim 5 wherein the collection means comprises an annular receptacle with open top and bounded by a portion of cylindrical wall belonging to the rod of the piston and a concentric annular surface abutting on the surface of said diaphragm sealing between said portion of rod wall and said concentric annular surface being provided by the third lip seal.

19. A pump as claimed in claim 5 wherein the collection means comprises an annular receptacle with open top and bounded by a portion of cylindrical wall belonging to the rod of piston and a coaxial cylindrical wall belonging to a tubular element on which said rod of said piston is sliding, the seal at the bottom of said annular receptacle being provided by an 0-Ring.

20. A pump as claimed in claim 5 wherein the collection means comprises an annular receptacle with open top and bounded by a portion of cylindrical wall belonging to the rod of piston and a generally cylindrical coaxial wall abutting at the bottom on an annular surface belonging to a diaphragm positioned between said plug and said hollow body, said diaphragm, having a seat for housing a sealing ring adapted to carry out sealing for said bottom of said annular receptacle.

21. A pump as claimed in claim 3 wherein said hollow body has two equal and diametrically opposite grooves receiving two equal and diametrically opposite protrusions belonging to the rod and conjugated with said grooves so as to guide the piston rod during the pump stroke.

22. A pump as claimed in claim 21 wherein the protrusions abut on the flat surfaces constituting the edge of the grooves so as to block the stroke of the piston rod.

23. A pump as claimed in claim 21 wherein said hollow body has two or more longitudinal grooves of different length each adapted to cooperate with a corresponding protrusion, made on the outer surface of the rod of said piston so as to define piston strokes corresponding to different doses of the liquid-gas mixture delivered by said pump.

24. A pump as claimed in claim 2 wherein the delivery device comprises provided with a liquid-gas mixture optimizing element interposed between the mixing chamber and the delivery duct.

25. A pump as claimed in claim 24 wherein the optimizing element has micro holes adapted to transform the gas-air mixture into foam.

26. A pump as claimed in claim 24 wherein the optimizing element comprises a nozzle adapted to atomize the gas-air mixture.

27. The pump as claimed in claim 4 wherein said elastic bellows has such a constant resistance at each section as to have a constant deflection during compression, the applied force being equal.

28. The pump as claimed in claim 27 wherein said bellows has a cylindrical shape.

29. The pump as claimed in claim 27 wherein said bellows has a frustum-conical shape.

* * * * *